US006527518B2

(12) United States Patent
Ostrowski

(10) Patent No.: US 6,527,518 B2
(45) Date of Patent: Mar. 4, 2003

(54) WATER-POWERED SUMP PUMP

(76) Inventor: Michael H. Ostrowski, 499 S. Ridge Rd., Lake Forest, IL (US) 60045

( * ) Notice: Subject to any disclaimer, the term of this patent is extended or adjusted under 35 U.S.C. 154(b) by 0 days.

(21) Appl. No.: 09/960,210

(22) Filed: Sep. 21, 2001

(65) Prior Publication Data

US 2002/0034444 A1 Mar. 21, 2002

Related U.S. Application Data

(60) Provisional application No. 60/234,293, filed on Sep. 21, 2000.

(51) Int. Cl.[7] ..... F04B 49/04; F04F 5/48
(52) U.S. Cl. ..... 417/40; 417/182.5
(58) Field of Search ..... 417/40, 54, 182.5, 417/43, 45

(56) References Cited

U.S. PATENT DOCUMENTS 1,253,095 A * 1/1918 Postle ..... 417/182.5
1,519,323 A * 12/1924 O'Laughlin ..... 417/172
1,568,221 A * 1/1926 Greenidge ..... 417/182.5
2,070,720 A * 2/1937 Ernst ..... 91/308
2,537,680 A * 1/1951 Kupiec ..... 137/596.15
3,963,376 A 6/1976 Miskin
4,060,341 A 11/1977 Tremain et al.
4,422,829 A 12/1983 Buchanan
4,482,299 A * 11/1984 Eulass ..... 417/54
4,934,404 A 6/1990 DeStefano
5,931,395 A * 8/1999 Sullivan ..... 241/146.013
5,971,304 A 10/1999 Sullivan

OTHER PUBLICATIONS www.plumbingwarehouse.com, "Water Powered —Back–Up Sump Pump.".
www.saginawpump.com, "Saginaw Pump."
www.versamatic.com, "Elima–Matic Pumps E4P/E4K, Plastic 1 1/2".
www.hydroMaid.com, "Hydromaid".

* cited by examiner

*Primary Examiner*—Teresa Walberg
*Assistant Examiner*—Vinod D Patel
(74) *Attorney, Agent, or Firm*—Dennis A. Gross; The Hill Firm

(57) ABSTRACT

A water-powered sump pump that utilizes a relatively higher pressure water ported through a self-reversing valve to a reversible stroke power cylinder having a movable member mechanically coupled to a pumping chamber for movement of a movable pumping member in the pumping chamber, movement of the movable pumping member forcing sump water to a discharge. The volumes of the power cylinder and pumping chamber are different such that relatively high pressure, low volume flow to the power cylinder results in relatively high volume, low pressure flow from the sump pumping chamber. The discharge from the power cylinder is backflow prevented with respect to the discharge from the sump pumping chamber.

13 Claims, 2 Drawing Sheets

WATER-POWERED SUMP PUMP

RELATED APPLICATION

This application claims benefit of Provisional Application No. 60/234,293 filed Sep. 21, 2000.

FIELD OF THE INVENTION

This invention relates to sump pumps and in particular to a water-powered sump pump.

BACKGROUND OF THE INVENTION

Sump pumps are normally electrically powered utilizing water level sensors to activate electric motor driven pumps. Because sump pumps are most frequently called upon during and immediately after storms, electric service may not be available throughout the time period in which the pump is required to act. While it has been known to provide battery backup systems to supply electric power during power outages, such backup systems are quickly drawn down, are difficult to maintain at optimum charge and require periodic replacement of the batteries.

It has been proposed to utilize water-powered pumping systems where a connection to a water supply, such as a municipal water system, may be available to provide an uninterrupted pressured flow even during times of electrical outage. Such devices may include venturi devices or turbine vane pumps.

While such devices may work during periods of electrical outage, they are relatively inefficient, having small pumping capacities in comparison to the volumes of water required, may have small operating heads, and provide back flow contamination problems, particularly in those situations, such as venturi devices, where the high-pressure water, generally potable water, mixes directly with the gray water from the sump.

It therefore would be an advance in the art to provide a non-electrically driven sump pump having relatively higher efficiencies than current water-powered sump pumps.

It would be a further advance in the art to provide a relatively high efficiency water-powered positive displacement sump pump which avoids back flow problems.

It would be a further advance in the art to provide a water-powered sump pump utilizing a reciprocating positive displacement pump having a pumping chamber submerged in the sump with a drive chamber connected to a pressure water supply, the drive chamber spaced from the pumping chamber and employing a reversing valve to reciprocate the positive displacement pump.

SUMMARY OF THE INVENTION

These and other advantages and features of the invention are provided by my design which incorporates a positive displacement pump including a pump chamber received in the sump having an intake open to the sump and a discharge to waste which employs a reciprocating driving member driven by a mechanical connection to a drive or power chamber which in turn has a reciprocating member acted upon by pressure water to reciprocate the driving member, the pressure water being controlled by a reversing valve.

In one embodiment of the invention, the pump chamber, positioned adjacent to the bottom of the sump is provided with a reciprocating member such as a piston or a diaphragm which is linked by a piston rod to a reciprocating driving member, such as a piston or diaphragm, in a power cylinder spaced above the bottom of the sump. A flow-reversing valve alternately directs pressure water from a pressure water supply to one side or the other of the reciprocating member in the power cylinder thereby reciprocating the diaphragm or piston in the power cylinder. The volume of the power cylinder traversed by the driving member is a fraction of the volume of the pumping chamber traversed by the pumping member such that for an equal stroke length, a smaller volume of water in the pumping chamber at a higher pressure moves a larger volume of water in the pumping chamber at a lower pressure. Since normal line pressure from a municipal water system generally exceeds 25 psi (and may be in the range of 30–60 psi), and since the normal pump head from a sump to a discharge line, over the top of a building foundation to a storm sewer, is only on the order of five to twelve feet, volumetric pumping capacity on the order of three to five times greater are easily obtained. Such efficiencies permit the discharge from the pumping chamber to be drawn in with the gray water from the sump while still maintaining good pumping efficiency. By providing an air gap between the discharge of the power chamber and the high water level of the sump, the potable water system is effectively separated from the gray water and back flow cannot occur.

A standard float switch can be utilized to control an on/off valve for providing pressure water to the reversing valve and appropriate check valves may be provided to control intake and discharge from the pumping chamber.

In a further embodiment of this invention, the drive chamber can be positioned above the top of the sump with either a discharge directly to waste, preferably while maintaining an air gap, or with discharge directly to the sump.

It is therefore one object of this invention to provide a positive displacement, pressure water, sump pump having separated drive and pumping modules wherein the drive module includes a drive chamber having a reciprocating power member driven by pressure water through a reversing valve, the reciprocating power member being mechanically linked to a reciprocating pump member received in a pump chamber located adjacent to the bottom of a sump, with the pump chamber having inlets open to the sump and outlets open to discharge and where reciprocation of the reciprocating power member encompasses a volume less than the volume encompassed by reciprocation of the pumping member.

Other features of this invention will be apparent to those of ordinary skill in the art from the following description of a preferred embodiment, it being understood that those skilled in the art will appreciate that the preferred embodiments described may be easily modified with respect to most details thereof while maintaining the advantages of this invention.

DESCRIPTION OF THE PREFERRED EMBODIMENTS

Figure 1:
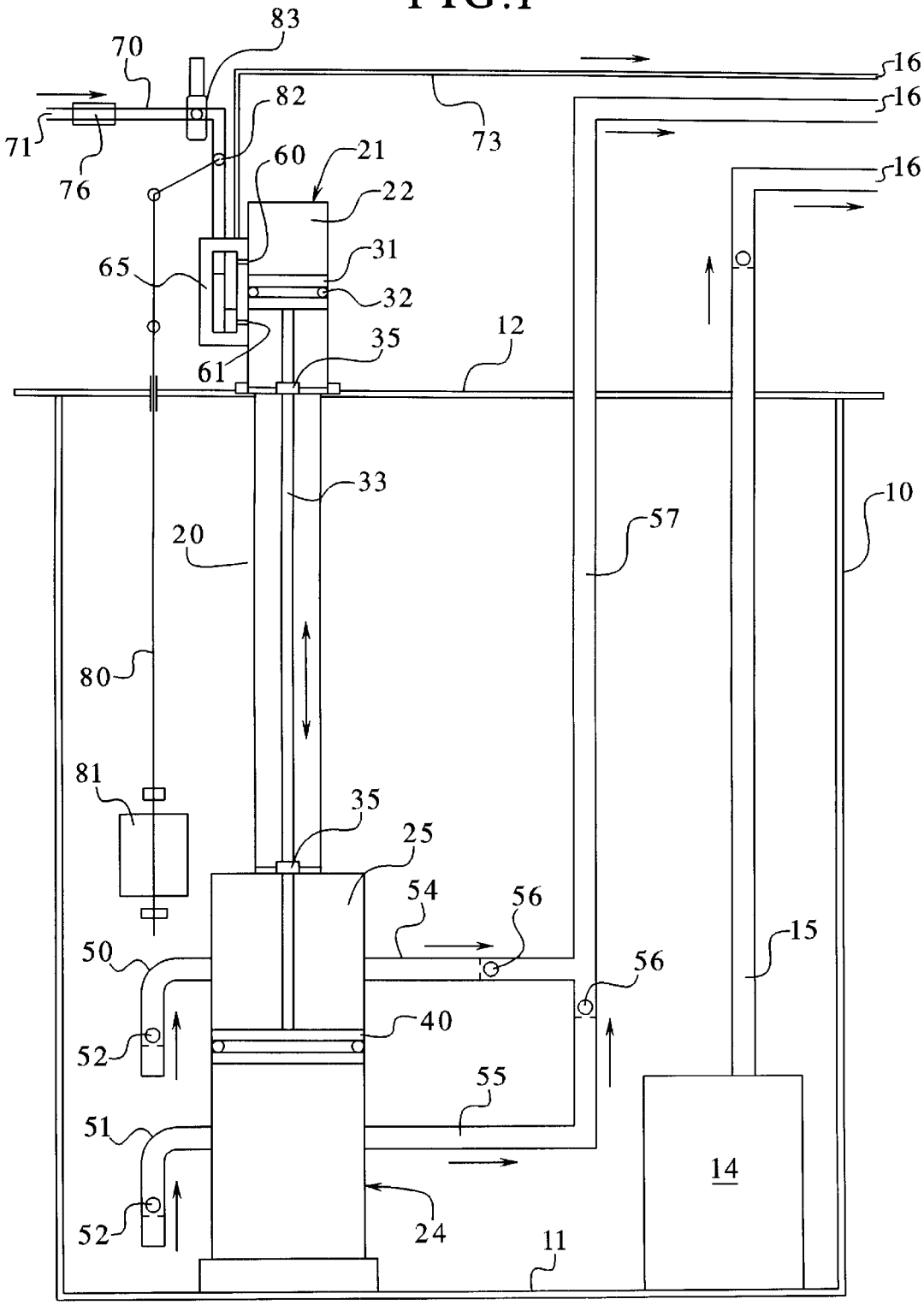
FIG. 1 is a schematic view of a water-powered sump pump utilizing a reciprocating pumping piston.

As shown in FIG. 1, a standard sump 10 having a sump bottom 11 and a sump cover 12 is provided with a typical electric sump pump 14 (which also may have a battery powered back up pump) having a discharge line 15 to waste 16. The sump pump 14 is line powered and/or batter powered may be actuated by any normal water level sensor such as, for example, by a float.

As is well known, sump pump such as 14 experience failures either due to the loss of electric power, motor bum out or pump bearing failure. In the case of battery powered pumps, draw down of batter power my also lead to failure. In such situations, it is desirable to have a back up pumping system, and preferably one not subject to failure for the same reasons as pump 14.

My invention provides a water-powered sump pump generally indicated at 20 which includes a drive chamber 21 containing a power cylinder 22 which, as illustrated, is positioned preferably exterior of the sump and a pump chamber 24 which includes a pump cylinder 25, located in the sump preferably adjacent to the bottom 11. If desired, a support tube 30 may connect the drive chamber and pump chamber 21 and 24 to provide an overall housing assembly.

The pump chamber 24 is illustrated as receiving a piston 31 which may be provided with seals such as an O-ring seal 32 and which is received in the cylinder 25. A piston rod 33 attached the piston 31 extends through seals 35 into the pump chamber 24 and connects with a pumping piston 40 in the pump cylinder 25. The piston rod 33 thus mechanically links the two pistons together. By use of a solid piston rod, one to one linear movement between pistons is achieved. It will be apparent that by substituting a lever linkage, that different relative movements could be obtained.

The pump cylinder 25 is provided with inlets 50 and 51 which may be equipped with ball-check valves 52. It would be appreciated that normally the inlet 50 will extend to adjacent the bottom of the sump as will the inlet 52. The openings from the inlet to the interior of the pump chamber 25 are positioned on either side of the piston to provide a double acting positive displacement pump where one of the areas above, or below, the piston will be drawing sump water in while the other is discharging previously drawn in sump water upon reciprocal movement of the piston 40.

It will be appreciated that although I have shown a double acting piston/cylinder with two inlets, if desired, the pump could be constructed as a lift piston having a single inlet to the lower position of the chamber and a one-way valve opening through the piston to a single discharge from the upper portion of the pumping chamber or as a single stage, two cycle piston pump.

The pump chamber as provided in the illustrated preferred embodiment is equipped with two discharge lines 54 and 55 provided with check valves 56. The two discharge lines can communicate to a common discharge pipe 57 which discharges to waste 16.

The drive chamber 21 is similarly provided with two inlets 60 and 61 at positions on opposite sides of piston 31. The inlets 60 and 61 are formed as a part of a reversing valve assembly 65 which will alternately supply pressurized fluid to either inlet 60 or 61. Such self-reversing valves are well known and may, if desired include pilot valves controlling movement of a main spool valve which controls the flow of fluid to the inlets 60 and 61. Such valves are common and are shown, for example, in U.S. Pat. No. 5,931,395, the teachings of which are herein incorporated by reference. In the embodiment illustrated in FIG. 1, the reversing valve 65 utilizes inlets 60 and 61 as combination inlets/outlets so that as pressurized fluid is being provided to one side of the piston 31, the other side of the piston is open through valve 65 to exhaust. Of course, separate inlets and outlets may be substituted.

The reversing valve 65 is provided with pressure water through a conduit 70 which in turn is connected to a source of pressure water such as the community potable water supply 71. An outlet conduit 73 may be provided from the reversing valve 65 to waste 16, in which case, in order to prevent contamination of the potable water supply, a back flow preventer 76 may be provided in conduit 70 or an air gap in conduit 77.

Figure 2:
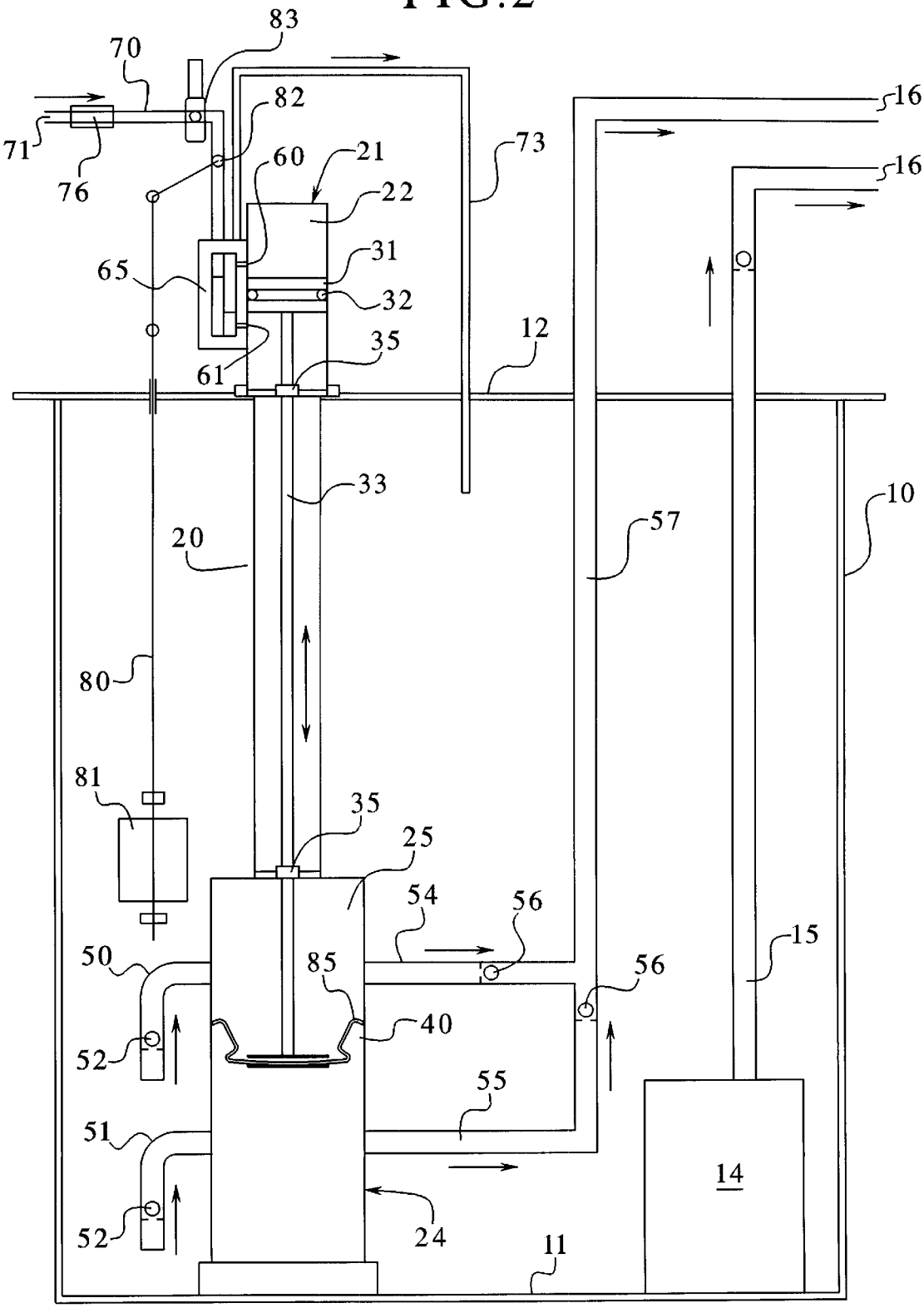
FIG. 2 is a modified water-powered pump utilizing a diaphragm pumping member.

However, as illustrated in FIG. 2, one advantage of separating the power cylinder 22 from the pumping cylinder or chamber 25 by a distance sufficient to raise the power cylinder above the maximum flood water level is that the discharge from the reversing valve 25 may be directly back into the sump. By providing an air gap between the reversing valve discharge and the maximum water level in the sump, back flow contamination is avoided. Thus, as illustrated in FIG. 2, the discharge 73 may extend back through cover 12 to the upper portion of the sump 10 where the sump top is above the maximum water level. Where the top of the sump is below the maximum water level the discharge may be provided with an air gap above the sump.

Activation of the system can be by any desired water level sensor. I have illustrated a standard float valve 80 incorporating float 81 linked to operate valve 82 in the pressure water line. Preferably float 81 will be positioned at a higher level in the sump than the level sensor for electric sump pump 14 whereby the water-powered sump pump system 20 will be activated only upon failure of the electric sump pump.

Alternatively, if desired, an electronically operated normally closed valve 83 may be provided connected to an electronic water level sensor. Since the power necessary to open and maintain open such a valve can be nominal, long lived batteries may be employed for such as system. It will, of course, be appreciated that other valving assemblies, level sensors and conduit arrangements may be utilized as desired. Further, where conditions may warrant, the driving housing 21 and pump housing 22 may be assembled together as a single unitary assembly to be positioned exterior of the sump with an intake conduit extending from the bottom of the pump to the inlets to the pumping chamber such that both the power chamber and the pumping chamber are positioned exterior of the sump. Conversely they could both be positioned within the sump with the reversing valve positioned exterior of the sump. Finally, it would be appreciated that the reversing valve similarly could be positioned interior of the sump and the outlet conduits for the reversing valve either ported direct to waste or open to the top of the sump above the maximum water level.

By providing a self-acting reversing valve, operated by the pressure of the inlet water, the systems acts totally based upon water pressure to maintain the sump pump. If desired the reversing valve could be operated by a physical connection to piston 31 or to piston rod 33, such that movement to adjacent top dead center or bottom dead center activates a linkage to a vale shifter.

Moreover, although I have shown both the driving assembly and the pumping assembly as employing pistons, it will be appreciated other positive placement pumps may be utilized. For example, in FIG. 2, the pumping member is a diaphragm 85. The power member in the power cylinder 22 could similarly be a diaphragm.

Importantly, as illustrated, the volume in the power cylinder 22 on each side of the piston or diaphragm is considerably less than the volume on either side of the piston or diaphragm in the pump cylinder 25. This allows for conversion of the energy stored in the pressure water to a larger volume flow from the pump. For example, if the volumes in the power assembly are one-fourth the volume in the pumping assembly, approximately four times as much water can be pumped from the pumping assembly, at a correspondingly reduced pressure. This can provide for a relatively highly efficient pumping system while allowing the discharge from the power assembly to be ported directly to the sump to be pumped away as part of the gray water waste. It will be appreciated that, as used herein, the term volume is directed to the volume encompassed within the movement of the pistons.

Although I have shown my invention as embodied in a preferred embodiment shown in the drawings, it would be appreciated that others may wish to utilize my invention in different forms and use different component parts. Those skilled in the art will readily recognize that the embodiment described herein represents merely one possible use of my invention.

I claim as my invention:

1. A water-powered sump pump comprising a pumping member received in a pumping chamber, a power member received in a power chamber, a mechanical connection between the power member and the pumping member, the power member and pumping member being reciprocally moveable, a pressure water feed to the power member for reciprocating the power member by application of pressure water to the power member, a sump intake to the pumping chamber and a discharge outlet from the pumping chamber, and a water level sensor in the sump effective to operate a valve to supply pressure water to the pumping member in dependent response to sensed water level.

2. The pump of claim 1 wherein a reversing valve controls the flow of pressure water to alternate sides of the power member.

3. The pump of claim 2 wherein the pumping chamber is positioned in the pump.

4. The pump of claim 3 wherein the power member is a piston.

5. The pump of claim 4 wherein the pumping member is a piston.

6. The pump of claim 3 wherein at least one of the pumping member and power member is a diaphragm.

7. The pump of claim 2 where in the pumping member separates the pumping member into two sub chambers, each sub chamber having a sump inlet and an outlet, the inlet and outlet provided with check valves.

8. The pump of claim 6 wherein the pumping member separates the pump chamber into first and second sub chamber and wherein when pressure water is applied to one of the sub chamber, the other sub chamber is discharged.

9. The pump of claim 7 where in the discharge of the other sub chamber is to the sump.

10. The pump of claim 1 wherein the volume of the pumping chamber traversed by a movement of the pumping member is greater than the volume of the power chamber traversed by the power member.

11. A water-powered sump pump device for use with a sump comprising: a pressure water inlet in fluid flow communication to a drive chamber, a moveable member positioned with respect to the drive chamber to be acted upon by water from the inlet to move the member, a sump water inlet to a driven chamber, a second moveable member positioned with respect to the driven chamber to act upon water from the sump water inlet, a connection between the moveable member and the second moveable member effective to cause movement of the second moveable member in dependent response to movement of the moveable member, a first valve controlling pressure water supply to the water inlet in dependent response to water level in the sump, first and second fluid flow connections from the water inlet to the drive chamber, a second valve controlling fluid flow through the first and second fluid flow connections to the interior of the drive chamber to cause reciprocation of the moveable member within the drive chamber, at least one discharge outlet from the drive chamber.

12. The pump of claim 11 wherein the discharge from the outlet from the drive chamber is to the sump.

13. A water-powered positive displacement sump pump comprising a pumping chamber positioned adjacent to the bottom of the sump including a pump cylinder within the pumping chamber, a reciprocating pump member received within the pump cylinder, a first inlet to the pump chamber above the reciprocating member, a second inlet to the pump cylinder below the reciprocating pump member, the inlets open to the lower portion of the sump, at least one outlet from the pump cylinder, the outlet communicating flow from the pump chamber to waste, a drive chamber positioned above the sump including a drive cylinder having a reciprocating drive member received therein, a mechanical connection between the drive member and the pump member for transmitting motion from the drive member to the pump member, first and second drive inlets to the drive cylinder, the first inlet open to the drive cylinder above the drive member, the second inlet open to the drive cylinder below the drive member, a reversing valve connected to the drive inlets and to a source of pressured water, the reversing valve effective to alternatively direct pressure water to one of the drive inlets, a sump water level float operatively connected to a pressure water valve controlling flow of pressure water to the reversing valve, at least one discharge from the drive cylinder, the discharge from the drive cylinder discharging spent pressure water from the drive cylinder to waste through a flow conduit including an air gap.

* * * * *